US005947160A

United States Patent [19]

Addis et al.

[11] Patent Number: 5,947,160

[45] Date of Patent: Sep. 7, 1999

[54] LOOP HOLDING MECHANISM FOR USE IN A MULTI-AXIAL YARN STRUCTURE FORMING MACHINE

[75] Inventors: Stephen Robert Addis, County Antrim; Derek James Simpson, Belfast; Michael Richard Pye; Denis Boland, both of County Down, all of Ireland

[73] Assignee: Short Brothers PLC, Belfast, United Kingdom

[21] Appl. No.: 08/875,518

[22] PCT Filed: Feb. 5, 1996

[86] PCT No.: PCT/GB96/00238

§ 371 Date: Feb. 9, 1999

§ 102(e) Date: Feb. 9, 1998

[87] PCT Pub. No.: WO96/24713

PCT Pub. Date: Aug. 15, 1996

[30] Foreign Application Priority Data

Feb. 6, 1995 [GB] United Kingdom ..... 9502258

[51] Int. Cl.[6] ..... D03D 41/00

[52] U.S. Cl. ..... 139/11; 139/DIG. 1; 442/204

[58] Field of Search ..... 139/11, DIG. 1; 442/204

[56] References Cited

U.S. PATENT DOCUMENTS 5,137,058 8/1992 Anahara et al. .
5,431,193 7/1995 Mood et al. ..... 139/11
5,540,260 7/1996 Mood ..... 139/11

FOREIGN PATENT DOCUMENTS

0263392-A2 4/1988 European Pat. Off. .
0474090 3/1992 European Pat. Off. .
0573132-A1 12/1993 European Pat. Off. .
92/14876 9/1992 WIPO .
94/16131 7/1994 WIPO .

*Primary Examiner*—Andy Falik
*Attorney, Agent, or Firm*—Lyon & Lyon LLP

[57] ABSTRACT

In a loop holding mechanism (31), loop engaging pins (39) which are carried by pin blocks (38) are arranged successively to engage at a feed end (310) of the mechanism loop portions of yarns formed at opposite side edges of a multi-axial yarn structure being formed. The pin blocks (38) at each side of the mechanism (31) advance in abutting relationship along an advancement track (32) to a delivery end (311) of the mechanism (31) where they are returned along a return track (34) and again engaged in the successively formed loop portions. The pin blocks (38) are biased by biasing devices (48, 53) into abutting engagement with each other in the advancement track (32) to provide accurate control of the spacing between the pins (39) engaging the loop portions and are advanced along the advancement track (32) by a drive pinion which engages in turn each pin block (38) advanced to it to move the engaged pin block (38) an all the pin blocks (38) in the advancement track (32) in the direction of the delivery end (311) of the mechanism.

22 Claims, 12 Drawing Sheets

LOOP HOLDING MECHANISM FOR USE IN A MULTI-AXIAL YARN STRUCTURE FORMING MACHINE

BACKGROUND OF THE INVENTION

The present invention relates to a loop holding mechanism for holding and engaging loop portions of yarns successively produced at opposite side edges of a multi-axial yarn structure being formed and a machine for forming a multi-axial yarn structure.

It has been proposed to provide a machine for producing multi-axial yarn structures in which warp yarns are supplied in a warp feed direction in the form of a warp sheet and in which a yarn transfer device is provided which subjects warp yarns to successive bias yarn forming steps in which each yarn is caused to move in a succession of lateral transfer steps in a first weft direction to move from a first bias yarn reversal position to a second bias yarn reversal position and then to move in a succession of return lateral transfer steps in the opposite direction from the second bias yarn reversal position to the first bias yarn reversal position thereby to form a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction and in which each bias yarn at each reversal position in proceeding from a transfer step in one direction to a transfer step in the opposite direction forms a bias yarn loop portion.

In publication EP 0263392-A2 there is disclosed a machine for forming a two dimensional tetra-axial woven yarn structure embodying warp yarns, weft yarns and a bias yarn assembly having two bias yarn sub-assemblies in which the bias yarns of each are inclined to the bias yarns of the other and to the warp and weft yarns. The machine includes a yarn transfer device for progressively transferring yarns fed to it to provide the sub-assemblies of oppositely inclined bias yarns and in one form of yarn structure produced, the bias yarn sub-assemblies are arranged between outer warp yarns and outer weft yarns and the warp yarns are woven with the weft yarns to hold the intermediate bias yarns in place in the fabric.

The weaving together of the outer warp yarns and outer weft yarns in the machine disclosed in EP 0263392-A2 serves to hold the intermediate bias yarns in place in the structure and tensions in the bias yarns arising from their displacement by the traversing device are adequately absorbed in the woven structure thus formed.

In WIPO publication No. WO92/14876 a method of forming a three-dimensional woven yarn structure is disclosed in which use is made of a yarn transfer device for transferring yarns in the weft direction to provide bias yarn arrays in which the yarns are inclined to the warp feed direction and in which the arrays of inclined bias yarns are woven into other arrays of yarns by selective shedding of the yarns and insertion of weft yarns to produce the three-dimensional structure.

Again, the weaving of the arrays of bias yarns with other arrays of yarns and the insertion of weft yarns in the method disclosed in WO92/14876 allows the tensions in the bias yarns to be absorbed.

In U.S. Pat. No. 5,137,058 there is disclosed a machine for forming a three-dimensional yarn structure embodying warp yarns, weft yarns and non-woven bias yarns which are held together by binding warp yarns which pass through the yarn structure between adjacent non-binding warp yarns. The machine includes a yarn transfer device for progressively transferring yarns fed to it to provide non-woven sub-assemblies of oppositely inclined bias yarns which are fed into a binding zone where they are held in place within the warp and weft yarn structure by the binding warp yarns. The binding warp yarns are held captive at the upper and lower faces of the yarn structure by weft yarns inserted at each face. In addition, the bias yarns of the bias yarn sub-assemblies are held in place at their yarn reversal positions along each edge of the structure being formed by an outer binding warp yarn which passes through the bias yarn loop portions formed at the yarn reversal positions.

While the machine disclosed in U.S. Pat. No. 5,137,058 produces a three-dimensional yarn structure in which the non-woven bias yarn sub-assemblies are held in place by the binding warp yarns which pass through the structure and by the outer binding warp yarns, the yarn structure produced by the machine would have a tendency to reduce in width as a result of the tensions built up in the bias yarns of the bias yarn sub-assemblies.

In WIPO publication WO94/16131 a method of forming a multi-axial yarn structure is disclosed in which the two non-woven bias yarn sub-assemblies are formed in a yarn transfer device in which each yarn is caused in a succession of lateral transfer steps to follow the yarn preceding it from one position to another position in a lateral transfer path extending in the weft direction until the yarn has moved from a first bias yarn reversal position to a second bias yarn reversal position and then in a succession of return lateral transfer steps in the opposite direction and along the same transfer path until the yarn arrives at the first yarn reversal position. The lateral transfer steps and the return transfer steps are then successively repeated. The need to provide for a supply of yarns to the device from a rotary supply such as a rotary creel as required in the machine of U.S. Pat. No. 5,137,058 is by this mode of yarn transfer in the transfer device obviated.

The yarn structures produced in the method disclosed in WO94/16131 includes the two bias yarn sub-assemblies formed by the yarn transfer device and additionally includes binding warp yarns which pass through the bias yarn sub-assemblies and which are held captive at the lower or upper face or at the lower and upper faces of the yarn structure by insertion of weft yarns.

While the yarn transfer device disclosed in WO94/16131 has the advantage that it obviates the need for a rotary yarn supply, for example in the form of a rotary annular creel, there remains the disadvantage that the binding warp yarns which serve to hold the yarns of the bias yarn sub-assemblies in place in the structure may not in some circumstances adequately prevent the yarn structure being formed from reducing in width under the tensions developed in the bias yarns of the two bias yarn sub-assemblies.

In European patent publication No. 0573132-A1 there is disclosed a machine for producing a three-dimensional woven yarn structure in which weft yarns are arranged in columns which extend from one face of the structure to an opposite face and are interlocked by warp yarns which extend through the structure from a first of the two faces of the structure along an inclined path to the opposite face of the structure and then along a return inclined path back to the first face of the structure to produce what is known as an angle interlock woven yarn structure. In addition, selvedge forming warp yarns are woven into the structure so as to successively pass from one face to the other and back through the structure between adjacent columns of weft yarns.

In the machine disclosed in EP 0573132-A1 the yarn structure is described as being formed in the machine with the width direction of the structure extending vertically and with the inclined bias yarns and the selvedge forming warp yarns extending between upper and lower faces of the structure being formed. Selvedge holding mechanisms are described for engaging the loop portions of the selvedge forming warp yarns at the upper and lower faces of the yarn structure to prevent a reduction in the width of the woven structure being formed due to tension produced in the warp yarns and with the aim of maintaining the width (height) of the woven structure constant.

In a first of the selvedge holding mechanisms disclosed in EP 0573132-A1, there is provided an arrangement of four guide rails which extend in the direction in which the woven yarn structure is delivered from the weaving zone of the machine. Two of the guide rails extend along the length of the upper face of the woven structure at opposite upper edges of the structure and the other two guide rails extend along the length of the lower face of the structure also at opposite lower edges of the structure. Each of the rails provides for the support of a multiplicity of roller hook elements and a holding bar is passed through each loop portion of the selvedge forming warp yarn at each of the upper and lower faces of the woven structure, where it is hooked at each end on hooks of the roller hook elements which are caused to enter into and engage in the two guide rails at that face. When the woven yarn structure reaches a discharge end of the selvedge holding mechanism the roller hook elements disengage from the guide rails and subsequently the holding bar which they have supported is removed manually or automatically from the loop portions of the selvedge forming warp yarns and then inserted manually or automatically into the loop portions of selvedge forming warp yarns at the entry end of the guide rails where roller hook elements are provided for supporting the bar.

In an alternative selvedge holding mechanism disclosed in EP 0573132-A2 the roller hook elements and the guide rails supporting them are replaced by pin blocks which are guided in guide rails and which carry pins which are arranged to engage in the loop portions of the selvedge forming warp yarns at the upper and lower faces of the yarn structure being formed. There is however no disclosure as to how the pins are brought into engagement with the loop portions and as to how they are fed into the entry ends of the guide rails, removed from the exit ends of the rails and then returned to the entry ends of the rails and the pins again engaged in further loop portions of the selvedge forming warp yarn.

While the selvedge holding mechanisms disclosed in EP 0573132-A1 provide a means by which the woven structure being formed can be prevented from reducing in width, there is no disclosure of a means by which this can be achieved automatically and with a precision necessary for the reliable production of non-woven and partially non-woven multi-axial yarn structures.

SUMMARY OF THE INVENTION

It is an object of the present invention to provide a loop holding mechanism for holding and engaging loop portions of yarns successively produced at opposite side edges of a multi-axial yarn structure being formed and a machine embodying the loop holding mechanism for forming a multi-axial yarn structure in which a non-woven bias yarn assembly is formed comprising two superposed non-woven bias yarn sub-assemblies in which the bias yarns of one sub-assembly are inclined to the bias yarns of the other sub-assembly and in both of which the bias yarns are inclined to the warp feed direction and in which the loop holding mechanism serves to reduce or eliminate the adverse effects of tension in the yarns of the bias yarn sub-assemblies in the formed multi-axial yarn structure by engagement and disengagement of loop portions of the bias yarns in a precise and reliable manner.

According to a first aspect of the present invention there is provided:

a loop holding mechanism for engaging and holding loop portions of yarns successively formed at first and second edges of a multi-axial yarn structure being formed, the loop holding mechanism comprising:

(a) a plurality of pin blocks each of which carries a loop engaging pin, (b) first and second pin block advancement tracks in which the pin blocks are advanced from first and second pin insertion stations to first and second pin retraction stations spaced from the first and second pin engaging stations in the direction in which the formed multi-axial yarn structure is to be advanced, (c) first and second pin block return tracks in which pin blocks are returned from the first and second pin retraction stations to the first and second pin insertion stations, (d) first and second pin-block insertion means at the first and second pin insertion stations successively to transfer pin blocks from the return tracks to the advancement tracks for insertion of pins of the pin blocks in loop portions successively formed at the pin insertion stations, (e) first and second pin-block retraction means at the first and second pin retraction stations to transfer the pin blocks from the first and second advancement tracks to the first and second return tracks thereby successively to retract pins of the pin blocks from the loop portions at the pin retraction stations, (f) advancement track pin block biasing means to bias the pin blocks in each of the pin block advancement tracks into abutting engagement with each other, and (g) a drive mechanism at a drive station in each of the advancement tracks to engage in turn each pin block advanced thereto under the bias of the biasing means to drive the engaged pin block and all the pin blocks in the advancement track between the drive station and the pin retraction station along the pin advancement track in the direction of the pin retraction station against the action of the biasing means to bring a pin block into the pin retraction station and to permit all pin blocks in the track between the drive station and the pin insertion station to advance in the advancement track under the bias of the biasing means to bring a pin block out of the pin insertion station and into the pin block advancement track and to advance a pin block into the drive station.

In an embodiment of the invention hereinafter to be described:

(a) the drive station in each of the advancement tracks is located a t a position along the track intermediate the pin insertion station and the pin retraction station and (b) the advancement track pin block biasing means comprises:

(i) forwardly acting biasing means located at the pin insertion station in each advancement track to bias the pin blocks between the pin insertion station and the drive station in the direction of the drive station and into abutment with each other and (ii) rearwardly acting biasing means located at the pin retraction station to bias the pin blocks between the drive station and the pin retraction station in the direction of the drive station and into abutment with each other.

In an embodiment of the invention hereinafter to be described:

(a) the drive mechanism at the drive station of each pin-block advancement track comprises a drive pinion located at the drive station and provided with equi-spaced peripheral teeth and (b) each pin block carries a tooth element which is engagable at the drive station by a peripheral tooth on the pinion for advancement of the pin block along the pin block advancement track upon rotary movement of the pinion.

In the embodiment of the invention hereinafter to be described:

(a) each pin insertion station includes a pin block insertion guide track extending between an exit end of the pin block return track and an entry end of the pin block advancement track and (b) the pin block insertion means provides for displacing a pin block at a pin block delivery position in the pin block insertion track at the exit end of the pin block return track to a pin insertion position in the pin block insertion track at the entry end of the pin block advancement track to insert the pin of the pin block in the yarn loop portion at the station and for entry of the pin block into the pin block advancement track.

In the embodiment of the invention hereinafter to be described:

(a) each pin retraction station extends between an exit end of the pin block advancement track and an entry end of the pin block return track and (b) the pin block retraction means provides for displacing a pin block at a pin block retraction position in the pin retraction station at the exit end of the pin block advancement track to retract the pin of the pin block from the yarn loop portion and to deliver the pin block to a pin block return position in the pin retraction station at the entry end of the pin block return track for entry into the pin block return track.

In the embodiment of the invention hereinafter to be described, a return track pin-block biasing means is provided at the entry end of the pin block return track to bias the pin block at the pin block return position and all the pin blocks in the pin block return track into abutting relationship for movement in the return track in the direction of the pin insertion station and each pin block arriving at the exit end of the return track is delivered to the pin block delivery position in the pin insertion station under the action of the return-track pin-block biasing means.

In the embodiment of the invention hereinafter to be described:

(a) the first pin block return track is arranged parallel to and above the first pin block advancement track, (b) the second pin block return track is arranged parallel to and above the second pin block advancement track, and (c) the pin block retraction means at each pin retraction station comprises a lifting device which engages the pin block at the pin block retraction position and lifts it to the pin block return position.

In an embodiment of the invention hereinafter to be described, the lifting device comprises a displaceable member carrying retractable support means which ride over the pin block in a downward excursion of the lifting device and engage under the pin block or a part or parts thereof to support the pin block during a return excursion of the lifting device, whereby the pin block is lifted to the pin block return position. The lifting device comprises a displaceable arm and the retractable support means takes the form of one or more spring biased pawls.

In an embodiment of the invention hereinafter to be described the pin block advancement and return tracks are arranged to provide for horizontal movement of the pin blocks and the pin insertion tracks and the pin block retraction means are arranged to provide for movement of the pin blocks vertically during insertion of pins of the pin blocks into the loop portions of the yarn structure being formed and during retraction of the pins of the pin blocks at the pin block retraction stations.

According to a second aspect of the present invention there is provided a machine for forming a multi-axial yarn structure comprising loop holding means according to the first aspect of the invention wherein:

(a) warp yarns are supplied in a warp feed direction in the form of a warp sheet and (b) a yarn transfer device is provided which subjects warp yarns to successive bias yarn forming steps in which each yarn is caused to move in a succession of lateral transfer steps in a first weft direction from a first bias yarn reversal position to a second bias yarn reversal position and then to move in a succession of return lateral transfer steps in the opposite direction from the second bias yarn reversal position to the first bias yarn reversal position thereby to form a non-woven bias yarn assembly comprising two superposed non-woven bias yarn sub-assemblies in which (i) the bias yarns of one sub-assembly are inclined to the bias yarns of the other sub-assembly, (ii) the bias yarns are inclined to the warp feed direction and (iii) the bias yarns at each bias yarn reversal position in proceeding from a transfer step in one direction to a transfer step in the opposite direction form bias yarn loop portions at the first and second edges of the structure being formed.

While the yarn traversing device may take a variety of different forms, the yarn transfer device may advantageously be such that each yarn is caused in a succession of lateral transfer steps to follow the yarn preceding it from one position to another position in a lateral transfer path extending in the weft direction until the yarn has moved from the first bias yarn reversal position to the second bias yarn reversal position and then in a succession of return lateral transfer steps in the opposite direction and along the same transfer path until the yarn arrives at the first yarn reversal position.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENT

Figure 1:
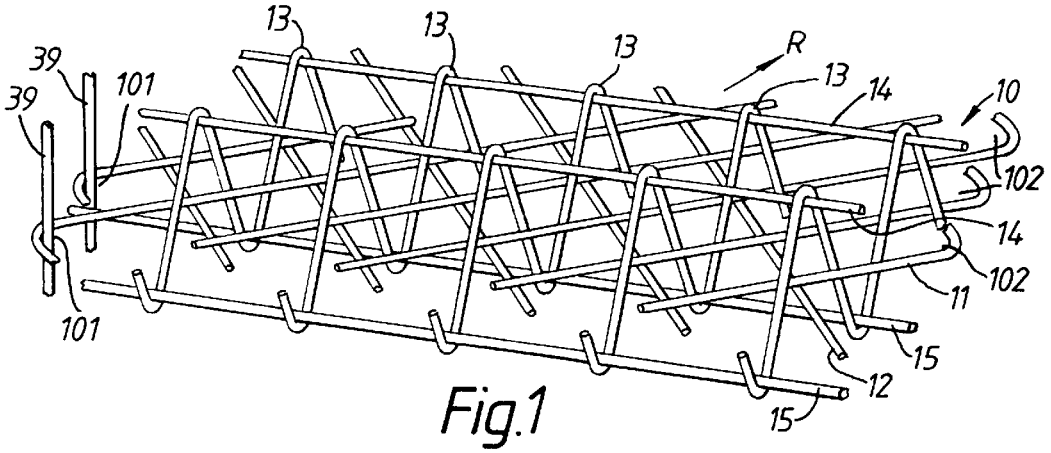
FIG. 1 is a schematic isometric view of a simple three-dimensional yarn structure which can be produced on the multi-axial yarn structure forming machine according to the invention and as illustrated in FIG. 2A.

Referring first to FIG. 1, a simple form of three-dimensional yarn structure is shown which can be produced on the multi-axial yarn structure forming machine to be described with reference to FIGS. 2A and 2B and FIGS. 3 to 8 and which comprises a non-woven warp yarn assembly composed of two superposed non-woven diagonal sub-assemblies of warp yarns 11 and 12 arranged at angles of ±45° to the reference warp direction R, a binding warp yarn assembly comprising binding warp yarns 13 extending in the warp feed direction and passing through the non-woven diagonal warp yarn sub-assemblies 11 and 12, an upper weft yarn assembly comprising weft yarns 14 and a lower weft yarn assembly comprising weft yarns 15.

Figure 2A:
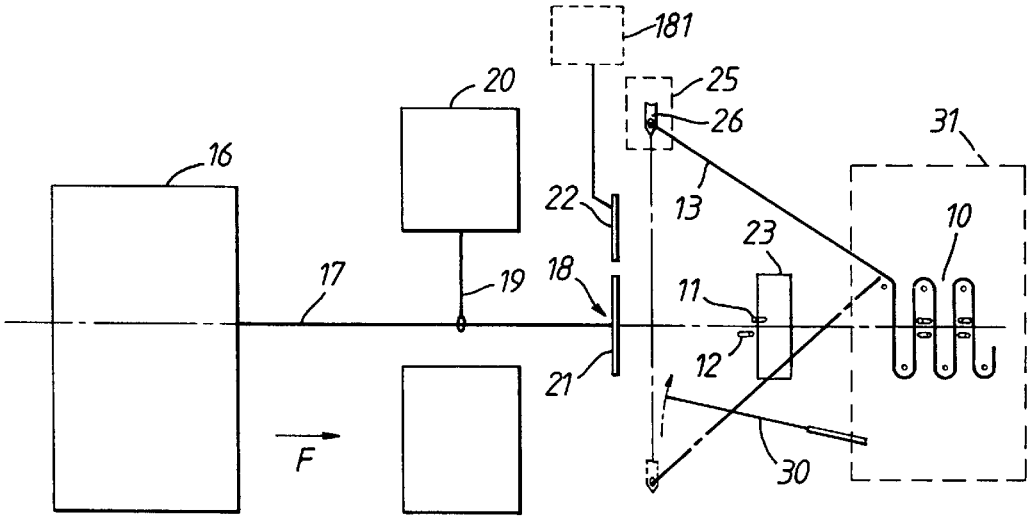
FIG. 2A is a block schematic diagram of a multi-axial yarn structure forming machine according to a first embodiment of the invention.

A multi-axial yarn structure forming machine is illustrated in outline in FIG. 2A for forming the yarn structure of FIG. 1 and comprises a creel 16 which supplies warp yarns in a warp sheet 17 in a warp feed direction F to a yarn transfer mechanism 18 following passage through yarn support elements 19 of a jacquard mechanism 20. Each warp yarn of the warp sheet 17 is supported by its own yarn support element 19 which can be raised and lowered under the control of the mechanism 20 to form sheds in which warp yarns of the warp sheet 17 are raised. Such mechanisms are well known in the art and can be used for making complex selections for the shedding of the warp sheet in the formation of fabrics of intricate pattern. The mechanism provided in the machine illustrated in FIG. 2A is employed also for raising and lowering warp yarns of the warp sheet 17 during yarn transfer carried out by the yarn transfer mechanism 18.

Figure 2B:
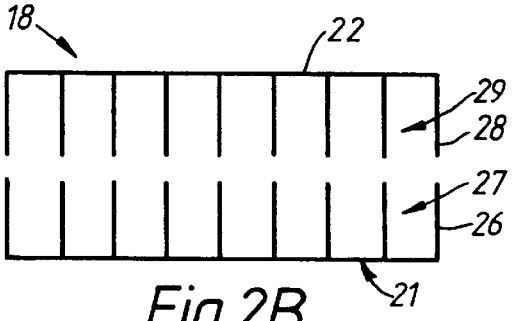
FIG. 2B is a schematic diagram of a yarn transfer mechanism of the machine shown in FIG. 2A.

The yarn transfer mechanism 18 shown more clearly in FIG. 2B comprises a lower yarn guide member 21 which extends in the weft direction throughout the width of the warp sheet 17 and includes upstanding yarn guide elements 26 which (i) extend through the thickness of the warp sheet 17, (ii) define warp yarn guide openings 27 through which the warp yarns of the warp sheet 17 pass and (iii) hold the warp yarns in predetermined positions spaced apart in the weft direction and a warp yarn transfer member 22 which also extends in the we ft direction and which includes spaced yarn guide elements 28 defining transfer openings 29 for the reception of yarns of the warp sheet 17 for transfer in the weft direction to produce the bias warp yarns 11 and 12 which are to form part of the yarn structure produced on the machine.

The yarn transfer mechanism 18 in the machine illustrated in FIGS. 2A and 2B subjects the warp yarns of the warp sheet 17 to successive bias yarn forming steps in which each yarn is caused to move in a succession of lateral transfer steps in a first weft direction from a first bias yarn reversal position to a second bias yarn reversal position and then to move in a succession of return lateral transfer steps in the opposite direction from the second bias yarn reversal position to the first bias yarn reversal position thereby to form two superposed non-woven bias yarn sub-assemblies as shown in FIG. 1, the bias yarns 11 of one sub-assembly being inclined to the bias yarns 12 of the other sub-assembly and at ±45° to the warp feed direction. Transfer of the bias yarns 11 and 12 by the transfer mechanism 18 is fully described in International Application PCT/GB94/00028 Publication WO94/16131. In the formation of the two non-woven sub-assemblies each bias yarn at each yarn reversal position in proceeding from a transfer step in one direction to a transfer step in the opposite direction forms as shown in FIG. 1 bias yarn loop portions 101 and 102 at opposite edges of the structure 10.

The machine shown in FIG. 2A also includes a weft insertion station 23 for inserting the weft yarns 14 of the structure shown in FIG. 1 and a binding warp yarn insertion mechanism 25 which includes an insertion needle 26 which provides for the insertion of the binding warp yarns 13 of the structure 10 shown in FIG. 1. It also includes a beater 30.

The yarn structure shown in FIG. 1 is formed from the two non-woven inclined bias yarns 11 and 12, the binding warp yarns and the upper and lower weft yarns 14 and 15 in a succession of processing steps in a cycle of operation following each transfer step of the yarns 11 and 12 in the yarn transfer mechanism 18. Following a bias yarn transfer step in the mechanism 18 a binding warp yarn insertion step is carried out in which binding warp yarn is passed through the bias yarn structure behind the bias yarns 11 and 12 by the insertion needle 26 followed by a weft insertion step in which a lower weft yarn is inserted at the weft insertion station 23 behind the binding warp yarn. This is followed by a beating up step using the beater 30 to bring the bias yarns 11 and 12 and the newly inserted lower weft yarn 15 to the fell point of the yarn structure being formed. The beater 30 is then retracted and the binding warp yarn needle 26 is returned to its retracted position following which a further weft yarn insertion step is carried out by insertion of an upper weft yarn behind the return run of the binding warp yarn and is followed by a further beating up step. The beater 30 is then returned to its retracted position to complete the steps in a complete cycle of operation of the machine which is then repeated by the commencement of the next yarn transfer step carried out by the transfer mechanism 18.

As is schematically illustrated in FIG. 2A the yarn structure 10 thus formed is delivered to a loop portion holding mechanism 31 now to be described with reference to FIGS. 3 to 8.

Figure 3:
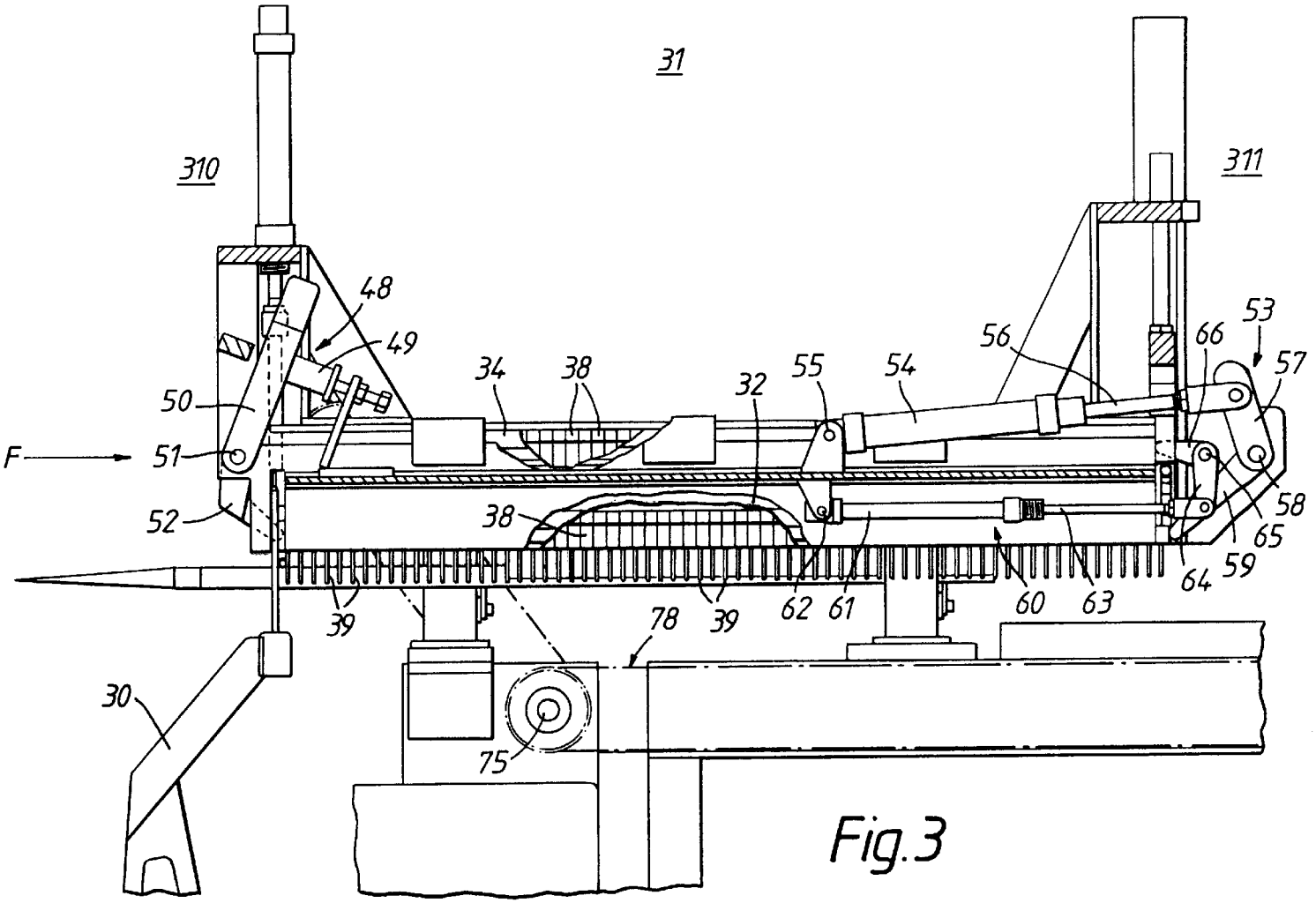
FIG. 3 is a schematic sectional side elevation of a loop portion holding mechanism for use in the machine as shown in FIG. 2A, the section being taken on the line III—III in FIG. 4.
Figure 4:
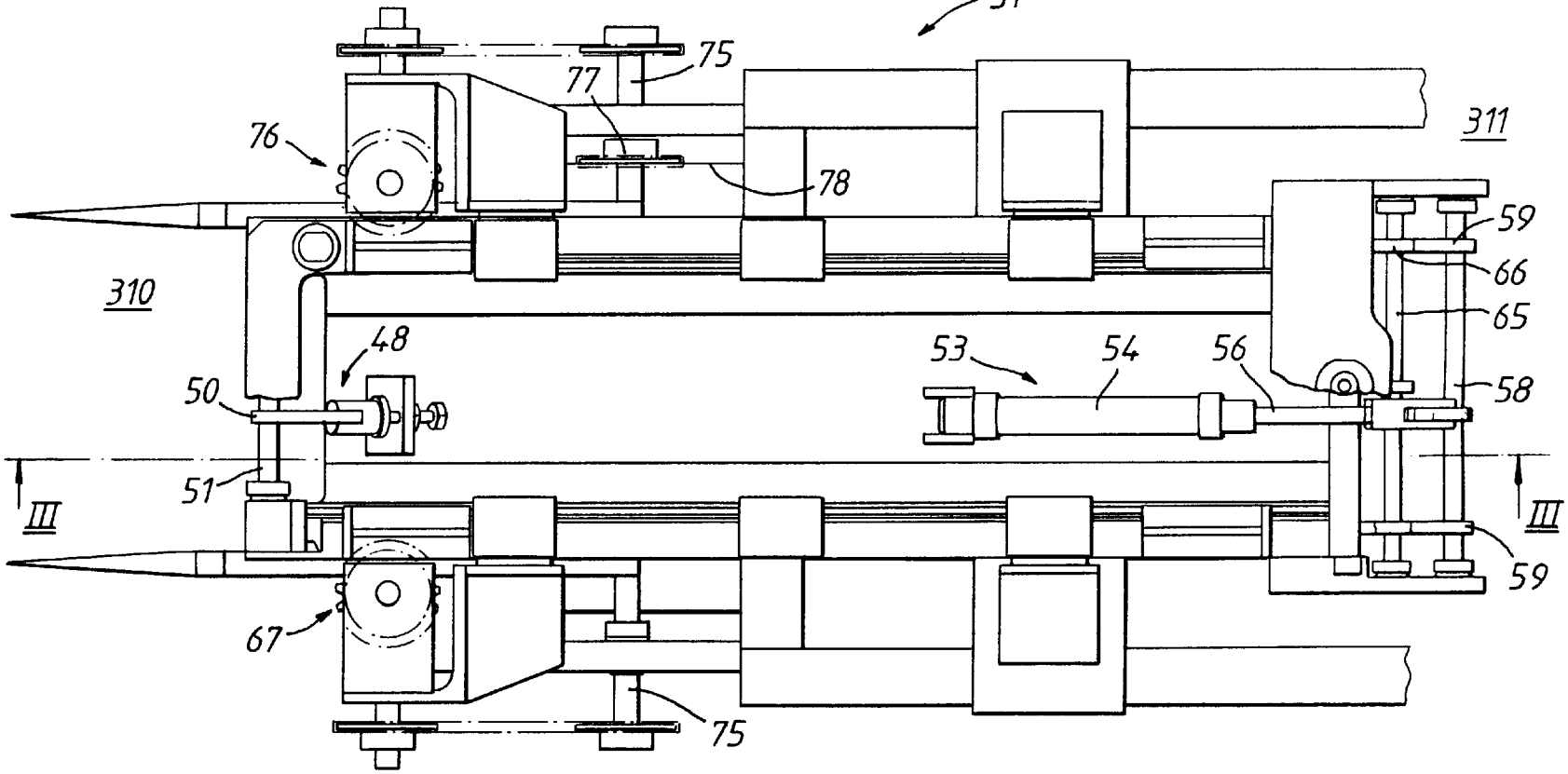
FIG. 4 is a schematic plan view of the loop portion holding mechanism shown in FIG. 3.

Referring now to FIGS. 3 and 4, and more particularly to FIG. 3, the mechanism 31 includes a feed end 310 to which the formed yarn structure 10 is fed in the direction F and a delivery end 311 from which the yarn structure 10 is delivered for further processing. The yarn structure 10 is in a manner hereinafter to be described advanced from the feed end 310 to the delivery end 311 under the control of pin blocks 38 which are arranged to advance in abutting relationship to each other along a pin block advancement track provided at each side of the mechanism 31 in a mode of operation in which pin blocks 38 at the feed end 310 are arranged successively to move down and into the pin block advancement tracks to bring the depending pins 39 thereon into yarn loop portions 101 and 102 at opposite side edges of the structure 10 and to advance with the structure 10 along the advancement tracks in the feed direction F, following which the pin blocks 38 are raised at the delivery end 311 to disengage the pins 39 from the yarn structure 10 and are moved into a pin block return track provided along each side of the mechanism for movement therein in a direction opposite to the feed direction F for subsequent further engagement of their pins 39 with the loop portions 101 and 102 at the feed end 310 of the mechanism. One pin block advancement track 32 is shown in FIG. 3, partly cut away to reveal the pin blocks 38 for advancement in the track and one pin block return track 34 is also shown partly cut away to reveal the pin blocks 38 arranged therein for return movement along the track.

Figure 5:
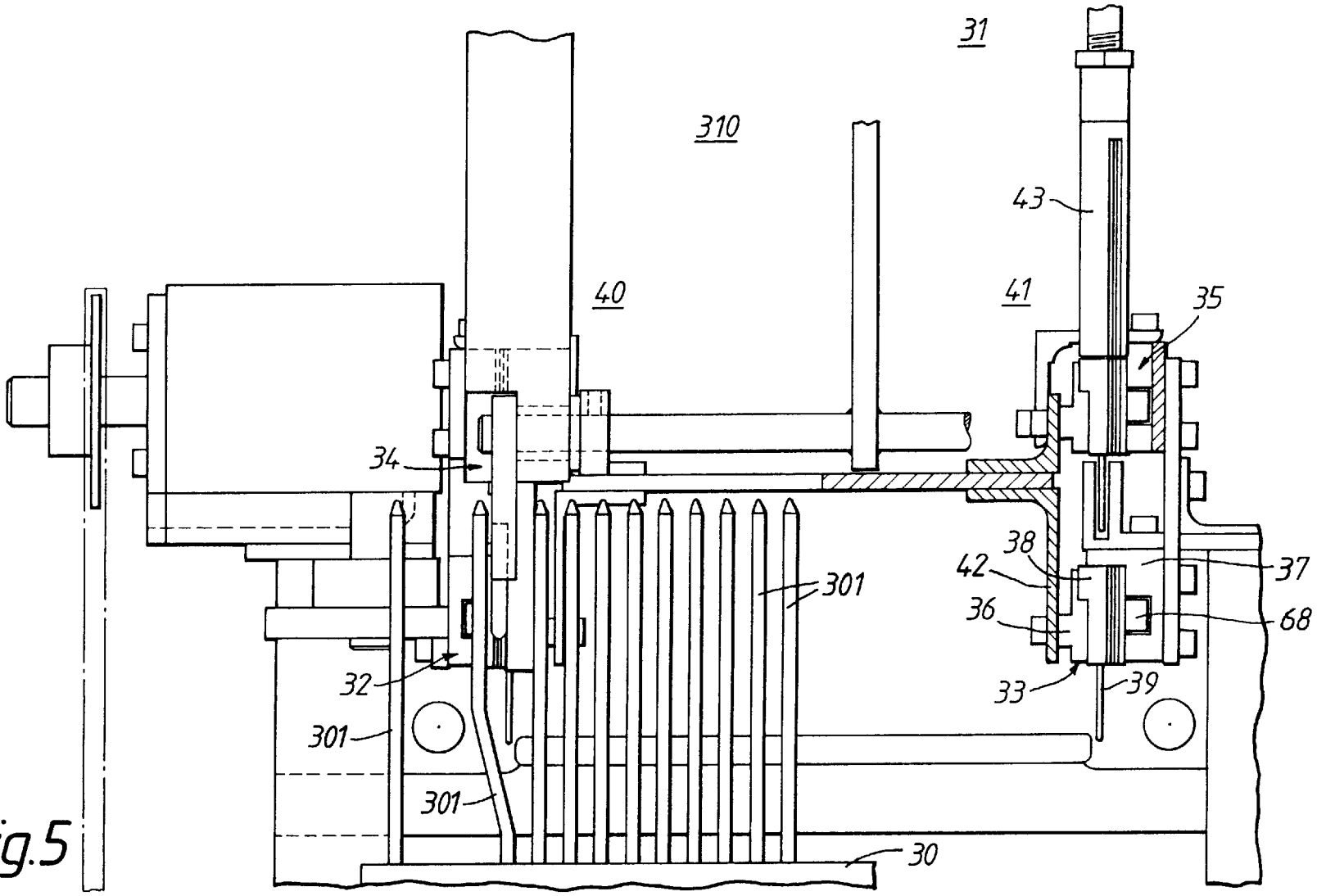
FIG. 5 is a part sectional end view of the loop portion holding mechanism shown in FIG. 3, viewed in the direction in which the formed yarn structure is fed to the mechanism.

Referring now to FIG. 5, which is an end view of the mechanism 31 showing the feed end 310 to which the formed yarn structure 10 is fed, the mechanism 31 includes the pin block advancement track 32 at one side of the mechanism and the further pin block advancement track 33 at the other side of the mechanism and the pin block return track 34 on the one side of the mechanism and the further pin block return track 35 on the other side of the mechanism. Each of the tracks 32 to 35 is provided with support structure 36 and 37 which serve to support for sliding movement therealong the pin blocks 38 carrying depending pins 39. The beater 30 is shown with upstanding beater pins 301.

At the feed end 310 of the machine, as shown in FIG. 5, the advancement and return tracks 32 and 34 terminate at a pin block insertion station 40 and the advancement and return tracks 33 and 35 terminate at a further pin block insertion station 41. Each of the pin block insertion stations 40 and 41 includes a pin block guide track structure 42 by which a pin block 38 on leaving the return track and taking up a pin-block delivery position in the guide track structure is guided to a pin insertion position at the entry end of the advancement track and a pneumatically operated plunger 43 is provided at each pin insertion station 40, 41 for engaging the pin block 38 at the pin-block delivery position and delivering it to the pin insertion position at the entry end of the advancement track.

Figure 6:
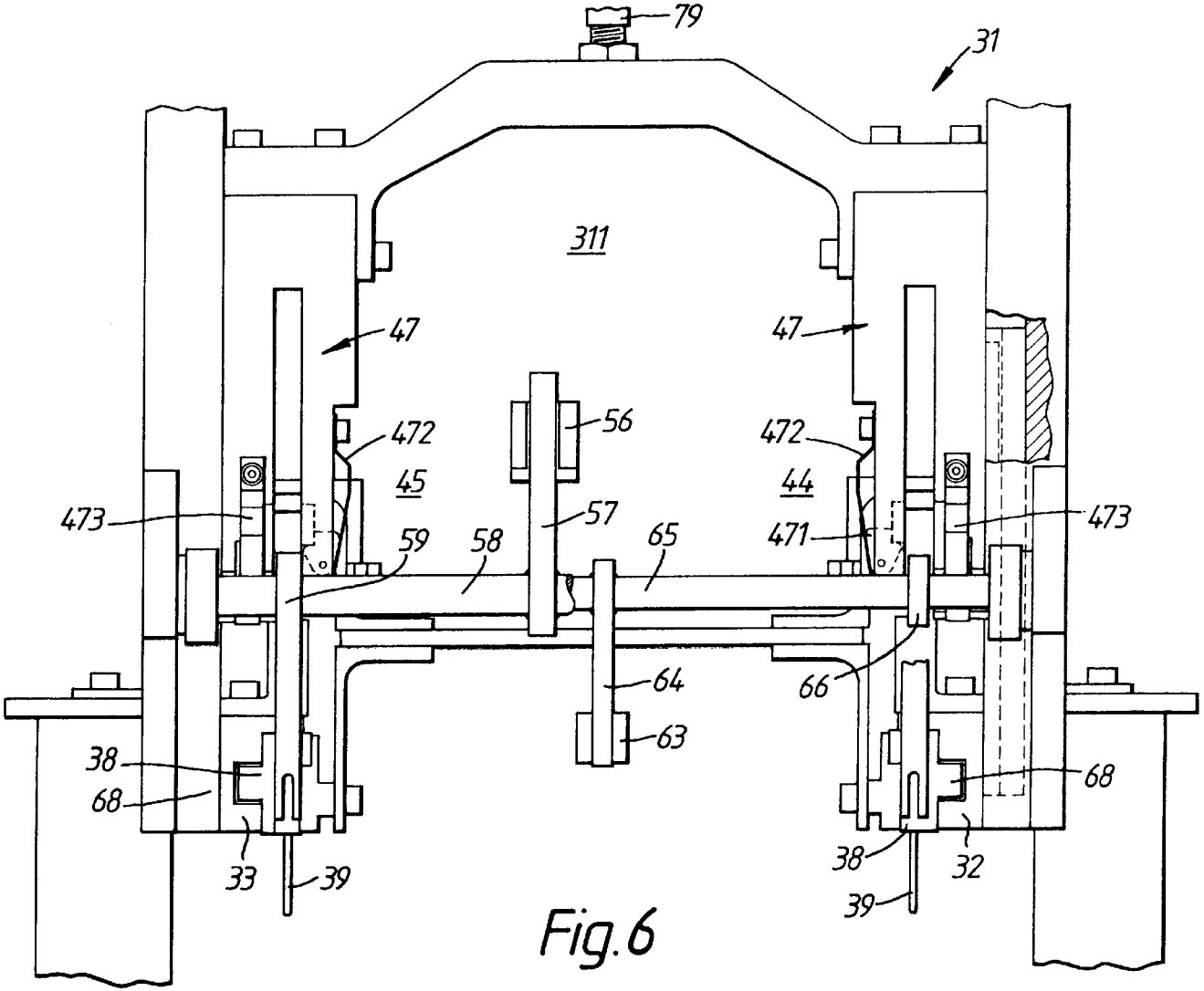
FIG. 6 is a schematic part sectional end view of the mechanism illustrated in FIG. 3 viewed in the direction in which the formed yarn structure is delivered from the mechanism and showing pin block retraction devices in raised dispositions.
Figure 7:
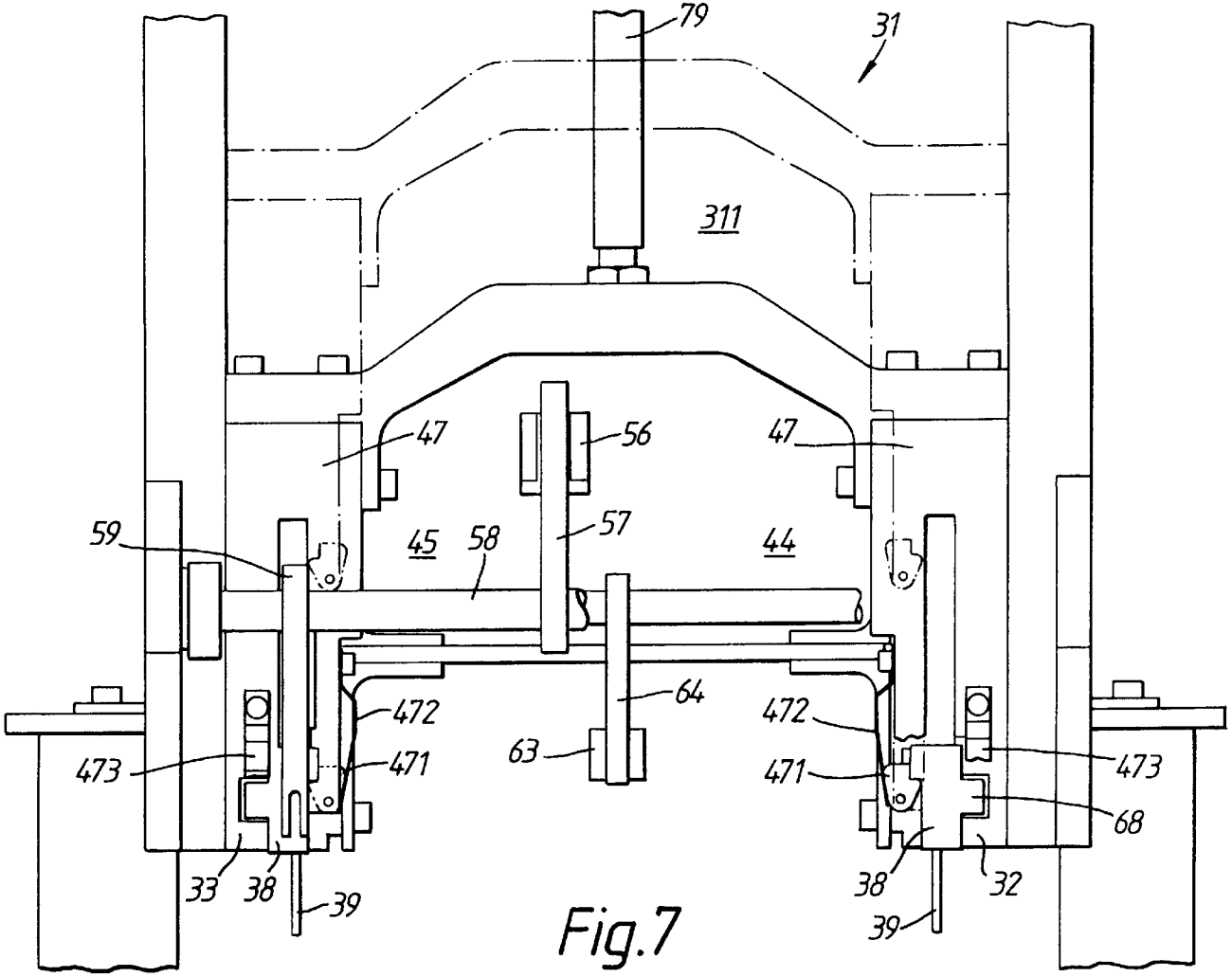
FIG. 7 is a schematic end view corresponding the end view shown in FIG. 6, except insofar that the pin block retraction devices are shown in lowered dispositions.

Pin blocks 38 are advanced along the pin block advancement tracks 32 and 33 from the feed end 310 of the machine shown in FIG. 5 to the delivery end 311 of the machine shown in FIGS. 6 and 7 and are then returned along the pin block return tracks 34 and 35.

At the delivery end 311 of the mechanism 31 as illustrated in FIGS. 6 and 7, the pin block advancement track 32 and the associated pin block return track (not shown) terminate at a pin retraction station and similarly the pin block advancement track 33 and the associated pin block return track (not shown) terminate at a further pin retraction station 45. Each of the retraction stations 44 and 45 includes a lifting device 47 which is arranged to engage a pin block 38 on leaving the pin block advancement track and on taking up a pin block retraction position and lift it to a pin block return position at the entry end of the pin block return track.

Referring again to FIGS. 3 and 4 the pin blocks 38 in the advancement track 32 are held in abutting relationship in the track 32 by a forwardly acting biasing structure 48 including a biasing spring 49 acting on a yoke member 50 fixedly mounted on a shaft 51 which carries a cranked biasing arm 52, the free end of which is arranged to bear against the pin block 38 at the entry end of the advancement track 32 thereby to bias the pin block and those in advance of it in the advancement track 32 into abutment with each other and in the direction of the delivery end 311 of the mechanism 31. The shaft 51 of the pin block biasing structure 48 is arranged to carry a further cranked biasing arm for biasing the pin blocks in the other advancement track 33 into abutting engagement with each other and in the direction of the delivery end 311. At the delivery end 311 a further biasing structure 53 is provided which comprises a pneumatic cylinder 54 secured at one end by a pivot pin 55 to the mechanism frame and carrying a biasing piston acting on a piston rod 56 to apply through a linkage 57 secured to a shaft 58 a biasing force on an arm 59, the free end of which exerts a rearwardly acting force on the pin block 38 at the exit end of the advancement track 32 and all the pin blocks 38 in the track 32 in opposition to the forwardly acting biasing force of the biasing structure 48 thereby to maintain the blocks 38 in abutting relationship to each other. The shaft 58 also carries a further biasing arm for biasing the pin blocks 38 in the advancement track 33 rearwardly into abutting engagement with each other and in the direction of the feed end 310.

The pin blocks 38 in the pin block return track 34 are urged in to abutting relation and in the direction of the feed end 310 of the mechanism 31 by a further biasing structure 60 which comprises a pneumatic cylinder 61 pivotally secured to the frame of the mechanism 31 by a pivot pin 62 and carrying a biasing piston acting on a piston rod 63 to apply through a link 64 secured to a shaft 65 a rearwardly acting biasing force on a biasing lever 66 which is secured to the shaft 65 and the free end of which bears on the pin block 38 at the entry end of the return track 34 urging engaged pin block 38 and all the pin blocks 38 in the return track 34 into abutting relationship with each other and in the direction of the feed end 310 of the mechanism 31. The biasing of the pin blocks 38 in the pin block return track 35 is provided by a further arm mounted on the shaft 65.

Figure 8:
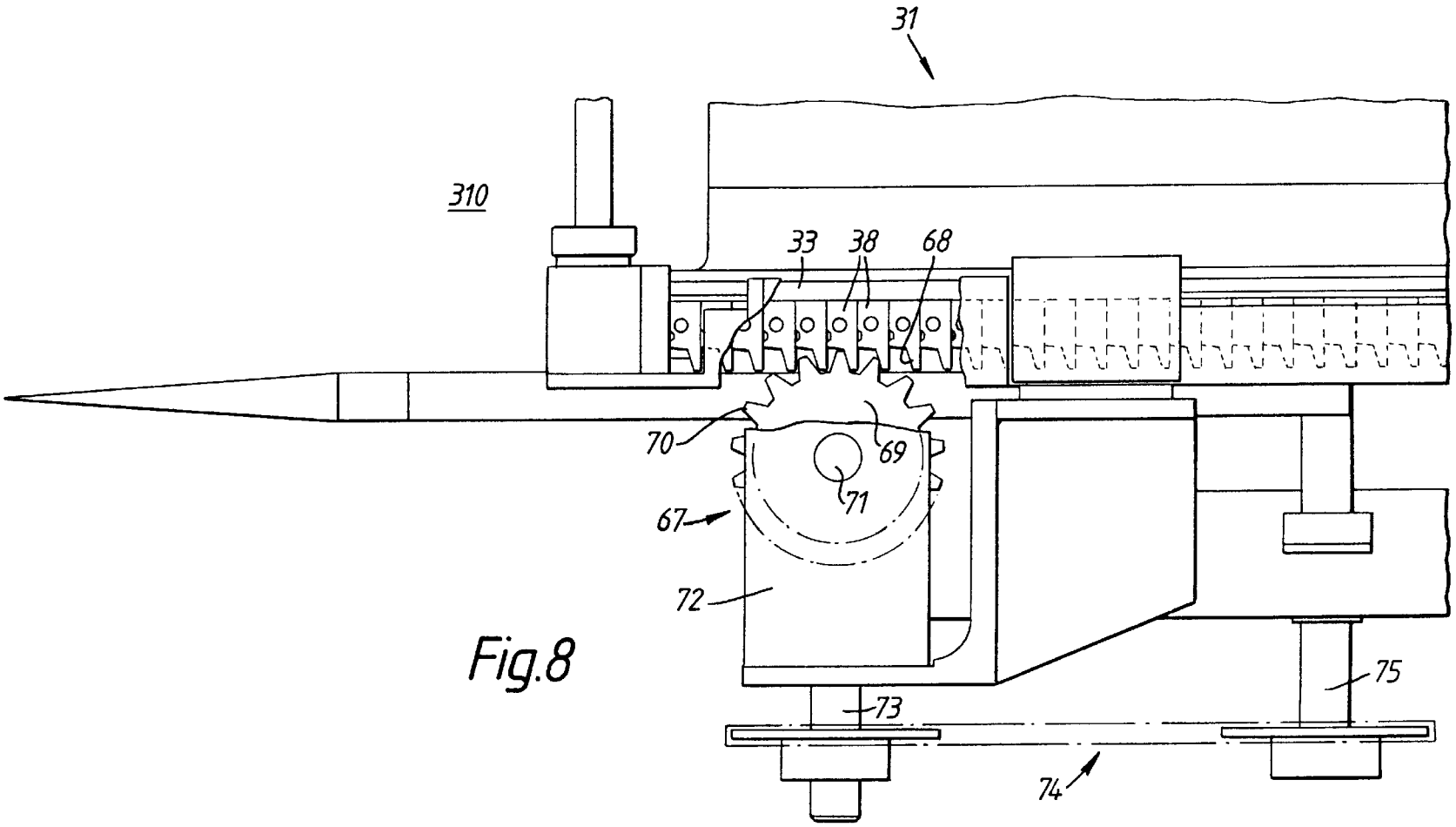
FIG. 8 is a part-sectional side elevation of a part of the mechanism illustrated in FIG. 3, showing a drive mechanism for advancement of pin blocks in pin block advancement tracks of the mechanism.

Referring now to FIG. 8, this is a plan view drawn to an enlarged scale of the feed end 310 of the mechanism 31 in the region of the pin block advancement and return tracks 33 and 35. Parts of the mechanism have been cut away to reveal pin blocks 38 in the pin block advancement track 33 which are arranged to be advanced in the track in the direction of the delivery end 311 of the mechanism 31 under the control of a drive mechanism 67. As will be seen, each pin block 38 carries a laterally extending tooth 68, the disposition of which is best illustrated in FIG. 5 and the drive mechanism comprises a pinion 69 carrying peripheral equi-spaced teeth 70 which upon rotation of the pinion 69 on a drive shaft 71 successively engage the tooth 68 on each pin block 38 in turn to advance it in the advancement track 33 against the biasing action of the pin block biasing structure 53. Advancement by the pinion 69 of the pin blocks 38 between the pinion and the exit end of the track 33 is accompanied by advancement of the pin blocks 38 between the pinion 69 and the feed end 310 of the mechanism under the forward biasing action of the pin block biasing structure 48. The drive shaft 71 is driven through a gear box 72 having an input shaft 73 driven through a chain drive 74 from a drive shaft 75, which also serves to provide a drive as shown in FIG. 4 for a drive mechanism 76 for advancing the pin blocks 38 in the pin block advancement track 32. As will be seen in FIGS. 3 and 4 the drive shaft 75 carries a sprocket 77 secured thereto which is driven by a chain drive 78 in turn driven by a principal machine drive controlling the take-off movements of the yarn structure forming machine illustrated in FIG. 2A.

The loop portion holding mechanism 31 as described is arranged to complete successive cycles of operation, each of which in the embodiment herein described commences following a bias yarn transfer step by the yarn transfer mechanism 18, a binding warp yarn insertion step, a weft insertion step and a beating up step using the beater 30 which brings the bias yarns 11 and 12 and the newly inserted lower weft yarn 15 to the fell point of the yarn structure being formed. The beater 30 is so arranged as to bring the loop portions 101 and 102 of the bias yarns 11 and 12 of the newly formed structure into position in the yarn insertion stations 40 and 41 and a complete cycle of operation of the mechanism 31 then follows.

To simplify description of the operation of the mechanism 31, reference will be made to movement of pin blocks 38 in the advancement and return tracks on one side only of the mechanism and it is to be understood that pin blocks 38 in the tracks on the other side of the mechanism will move in unison therewith.

Prior to commencement of a cycle of operation of the mechanism 31 a pin block 38 occupies the pin block delivery position at the exit end of the return track with the actuating plunger 43 in its raised position and a pin block 38 occupies at the exit end of each of the advancement tracks the pin-block retraction position in which it is engaged by the lifting device 47 and the actuator 79 is in the lowered position as shown in FIG. 7.

The cycle of operation of the mechanism 31 commences with the pin block 38 in the pin-block delivery position at the exit end of the return track being caused to move downwardly under the action of the actuating plunger 43 to the pin insertion position at the entry end of the advancement track thereby to cause pins 39 of the pin blocks 38 to engage in the loop portions 101 and 102 positioned at the pin insertion station.

During movement of the pin block 38 to the pin insertion position the biasing arm 52 is moved against the action of its biasing force to allow passage of the pin block 38, which upon arrival at the pin insertion position, is then biased by the arm 52 into abutting relation with the other pin blocks within the advancement track.

The lifting devices 47 (FIGS. 6 and 7) are then raised by retraction of the actuator 79 to bring the pin blocks 38 at the pin-block retraction positions at the exit ends of the advancement tracks 32 and 33 to the pin-block return positions at the entry ends of the return tracks 34 and 35, during which movement the biasing arms 66 of the biasing structure 60 are displaced by the pin blocks 38 and then take up dispositions biasing the raised pin blocks 38 into the entry ends of the return tracks 34 and 35.

Each insertion plunger 43 is then retracted to its retracted position shown in FIG. 5 and the pin blocks 38 in the return tracks 34 and 35 are urged by the biasing structure 60 along the return tracks to bring the foremost of the pin blocks 38 into the pin-block delivery position at the exit end of each of the return tracks and the pin block at the pin block return position in each of the pin retraction stations 44 and 45 into the entry end of the return track.

The lifting devices 47 at each of the pin retraction stations 44 and 45 are then lowered under the action of the pneumatic actuator 79 from the position shown in FIG. 6 to the position shown in FIG. 7.

Lowering of the lifting devices 47 is then followed by other weaving functions and by movement of the pinion 69 of each of the two drive mechanisms 67 and 76 to advance the pin blocks 38 in the advancement tracks 32 and 33 to bring the foremost of the pin blocks 38 into the pin block retraction stations 44 and 45.

Advancement of the pin blocks 38 along the advancement tracks 32 and 33 completes the cycle of operation which is then repeated by operation of the plungers 43 at the pin insertion stations 40 and 41, which bring the pin blocks 38 delivered to the pin insertion stations from the pin-block delivery positions at the exit ends of the return tracks and into the pin insertion positions following the next beating up operation of the bias yarns as previously described.

Support for the pin blocks 38 in the lifting devices 47 is, as shown in FIG. 7, provided by a spring biased pawl 471 which is carried at the end of a leaf spring 472 and which engages under an abutment face on the pin block 38 and a further spring biased pawl of the same form as the pawl 471 which is carried by a spring 473 and which engages under the tooth 68 in the pin block 38.

In the embodiment of the invention hereinbefore described, the steps in the cycle of operation of the mechanism 31 are such that the lifting devices 47 are lowered before movement of the foremost of the pin blocks 38 into the pin block retraction positions at the exit ends of the advancement tracks 32 and 33 under the action of the pinions 69.

In an alternative embodiment of the invention these steps are reversed and the pin blocks 38 advanced by the pinions 69 to bring the foremost of the pin blocks 38 into the pin retraction positions at the pin block retraction stations and the lifting devices 47 are then lowered from the position shown in FIG. 6 to the position shown in FIG. 7. During this movement the spring biased pawl 471 rides over the pin block 38 at the pin retraction position and engages under the abutment face on the pin block 38 and the further spring biased pawl carried by the spring 473 rides over the tooth 68 on the pin block 38 and engages under it.

The yarn structure of FIG. 1 is of simple form and the yarn structure forming machine illustrated in FIG. 2A for forming it is also of the simplest form. It will however be appreciated that in many practical applications the yarn structures will need to be of considerably more complex form and include for example additional superposed non-woven sub-assemblies of bias yarns positioned on the yarn structure above or below the non-woven sub-assemblies of bias yarns 11 and 12 and formed in the same manner as the sub-assemblies of bias yarns 11 and 12 and in addition to the binding warp yarns 13 additional warp yarns which extend in the reference warp direction R and which are either non woven or woven with weft yarns 15 or additional weft yarns. Furthermore, the yarn structure being formed may be one in which the binding warp yarns do not pass through the entire thickness of the structure, but pass round a weft yarn at an intermediate depth of the structure and further binding warp yarns employed to extend through the structure from the opposite direction to the intermediate depth where they pass round a weft yarn so that the structure finally produced can be folded back to produce for example a T-section structure.

While each warp yarn of the warp sheet 17 as described with reference to FIG. 2A is supported by its own yarn support element 19, it will be appreciated that in the weaving of some yarn structures it may be convenient to route several yarns through one yarn support element 19.

Furthermore, while the mechanism 20 provided in the machine illustrated in FIG. 2A is employed simply for raising and lowering warp yarns of the warp sheet 17 during yarn transfer carried out by the yarn transfer mechanism 18, it will be appreciated that the mechanism can with advantage be used for weaving layers of warp yarns with weft yarns.

The yarn transfer mechanism 18 described with reference to FIGS. 2A and 2B takes the form of a lower yarn guide member 21 having upstanding yarn guide elements defining yarn guide openings through which the yarns of the warp sheet 17 pass and a warp yarn transfer member 22 which includes spaced yarn guide elements defining transfer openings for the reception of yarns of the warp sheet 17 for transfer to other openings in the lower yarn guide member 21. In order to avoid contact of the yarns with the guide elements in their transfer between the yarn guide member 21 and the yarn transfer member 22, use may be made of eyelet elements through which the yarns of the warp sheet 17 pass and which are supported by the guide elements for sliding movement therealong into and out of the yarn guide openings and the yarn transfer openings as disclosed in and forming the subject of co-pending UK patent application No. 9416721.0 (International patent application publication No. WO96/06213).

In the yarn structure of FIG. 1 as produced by the machine illustrated in FIG. 2A, the bias yarns 11 and 12 are formed as two superposed non-woven bias yarn sub-assemblies in which the bias yarns 11 of one sub-assembly are inclined to the bias yarns 12 of the other sub-assembly and at ±45° to the warp feed direction. It will however be appreciated that by an appropriate modification to the operation of the transfer mechanism 18 the bias yarns 11 and 12 can be arranged to be inclined to each other and to the warp feed direction at angles other than ±45°.

In the yarn structure of FIG. 1 as produced by the machine illustrated in FIG. 2A the binding warp yarns are secured by upper and lower weft yarns 14 and 15. It will however be appreciated that for some purposes it may be desirable or preferable to arrange that the binding warp yarns are secured by passing round the bias yarns 11 and 12.

While advancement of the pin blocks 38 in the advancement tracks is achieved by a drive mechanism including chain drives 74, it will be appreciated that alternative drives, for example, worm drives could alternatively be used.

The yarn structure forming machine illustrated in FIG. 2A is described as carrying out a bias yarn transfer step, a binding warp yarn insertion step, a weft insertion step and a beating up step in bringing the components of the structure to the yarn insertion stations 40 and 41. It will however be appreciated that these steps may be augmented by additional steps in the formation of more complex yarn structures and the order of the steps varied.

It will be appreciated that the pin block biasing structures 48, 53 and 60 for maintaining the pin block 38 in abutting relationship as well as the pin blocks 38 themselves as described with reference to FIGS. 3 to 8 may take alternative forms, for example, as now to be described with reference to FIGS. 9 to 15.

Figure 9:
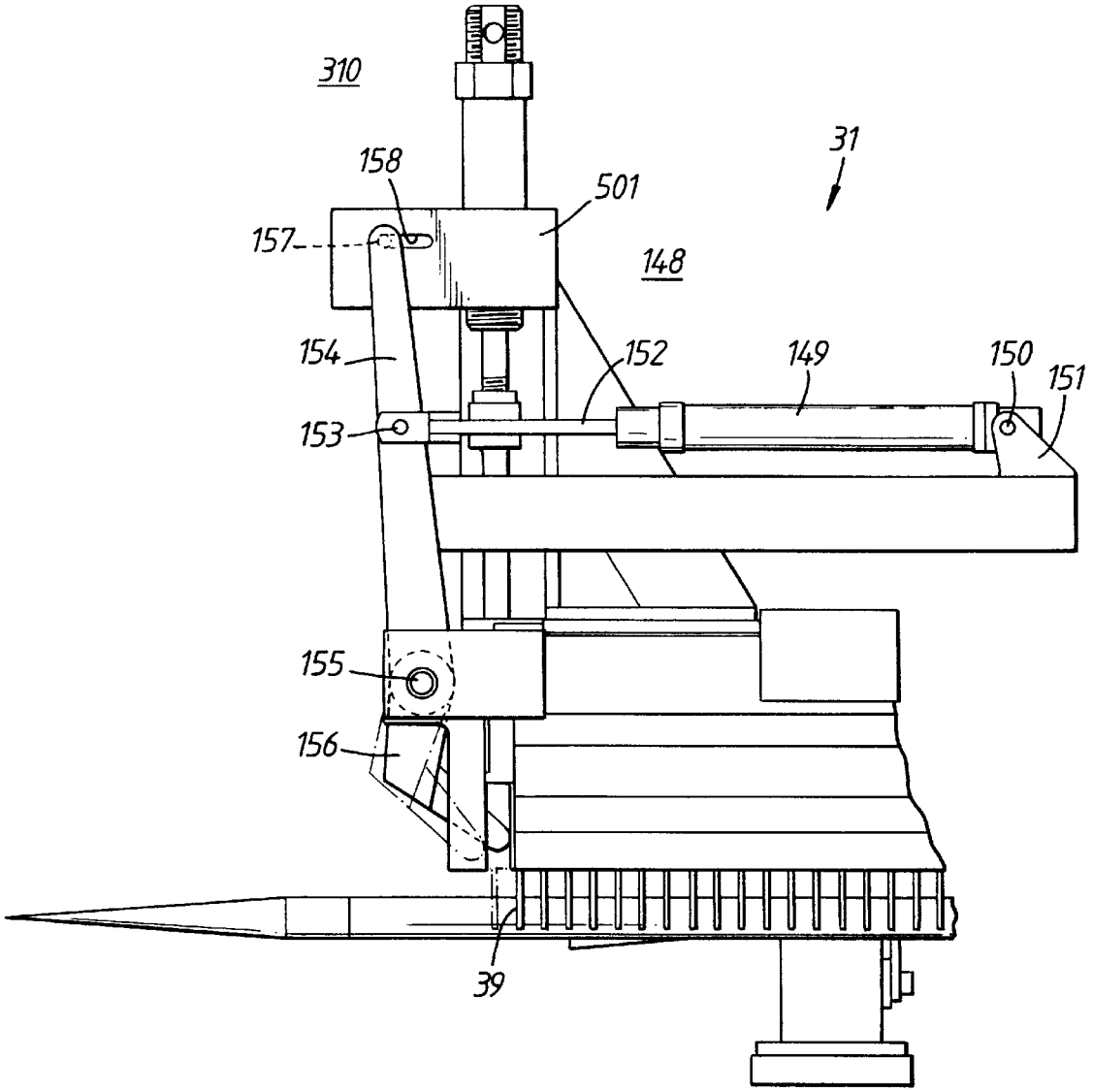
FIG. 9 is a schematic side elevation of the feed end of a loop portion holding mechanism for the machine shown in FIG. 2A in accordance with a second embodiment of the invention and showing to an enlarged scale an alternative pin block biasing structure at the feed end.
Figure 10:
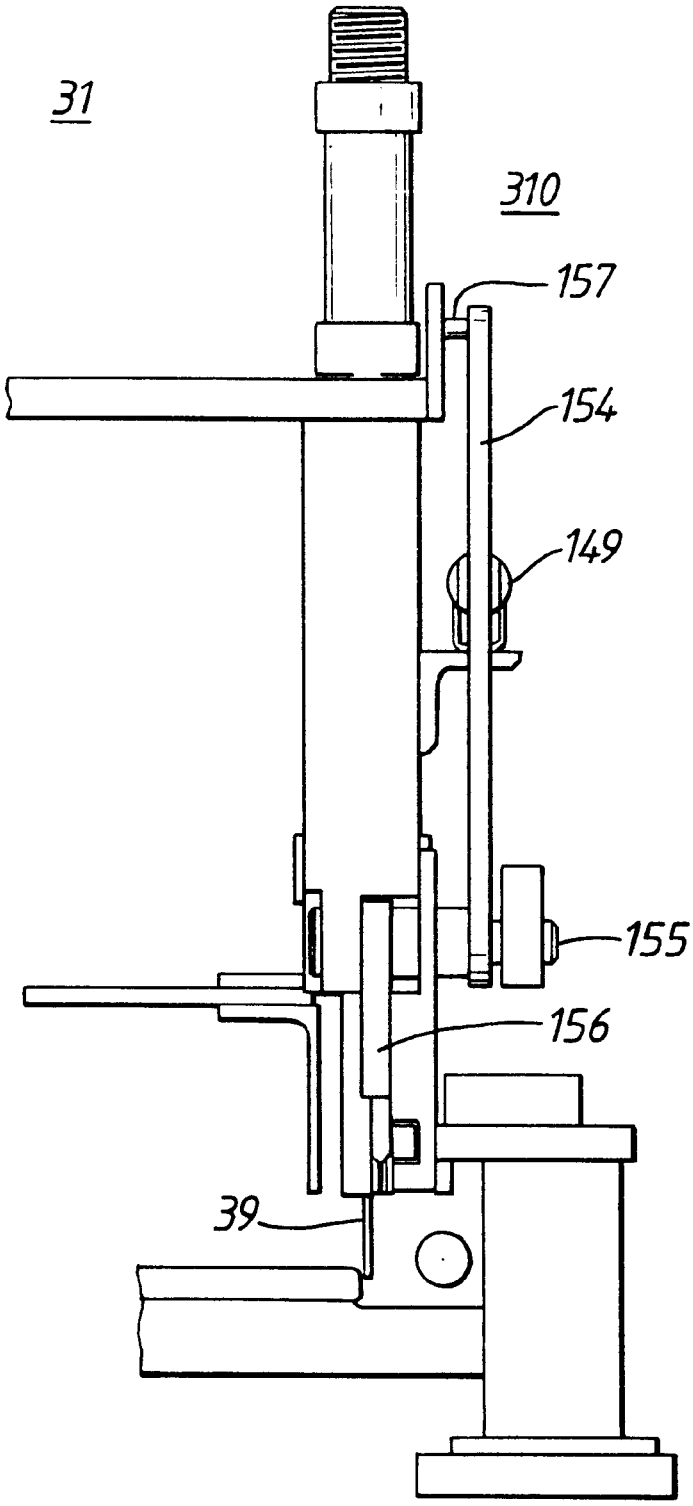
FIG. 10 is a schematic end view of the part of the loop portion holding mechanism shown in FIG. 9.

In particular, the forwardly acting biasing structure 48 of FIG. 3 by which the pin blocks 38 in the advancement tracks 32 are biased forwardly in the track into abutting relationship with each other may be replaced by the alternative biasing structure 148 illustrated in FIGS. 9 and 10 in which a pneumatic cylinder 149 replaces the spring 49. As will be seen, the cylinder 149 is secured at one end by a pivot pin 150 to support structure 151 of the mechanism frame and carries a biasing piston acting on a piston rod 152 to apply through a linkage 153 a biasing force on an arm 154 fixedly mounted on a rotatable support shaft 155 upon which is also fixedly mounted a cranked arm 156 which replaces the cranked biasing arm 52 of the biasing structure illustrated in FIG. 3.

It will be seen that the biasing structure 148 serves only to provide a biasing force on the advancement track on one side of the mechanism 31. An additional biasing structure not shown identical to the structure 148 is provided for applying a biasing force to the pin block 38 in the advancement track on the other side of the mechanism. It will however be appreciated that for some applications it may be found desirable or advantageous to employ a single biasing structure 148 as shown in FIGS. 9 and 10 and so to extend the shaft 155 as to enable it to carry a cranked arm 156 at each end for applying the appropriate biasing force to the pin blocks 38 in both advancement tracks.

The biasing structure 53 of the mechanism 31 described with references to FIGS. 3 to 8 for exerting a rearwardly acting force on the pin block 38 at the exit end 311 of each of the advancement tracks 32 and 33 as well as the biasing structure 60 for biasing the pin blocks 38 into the pin block return tracks 34 and 35 may be replaced by an alternative biasing structure 153 now to be described with reference to FIG. 11.

Figure 11:
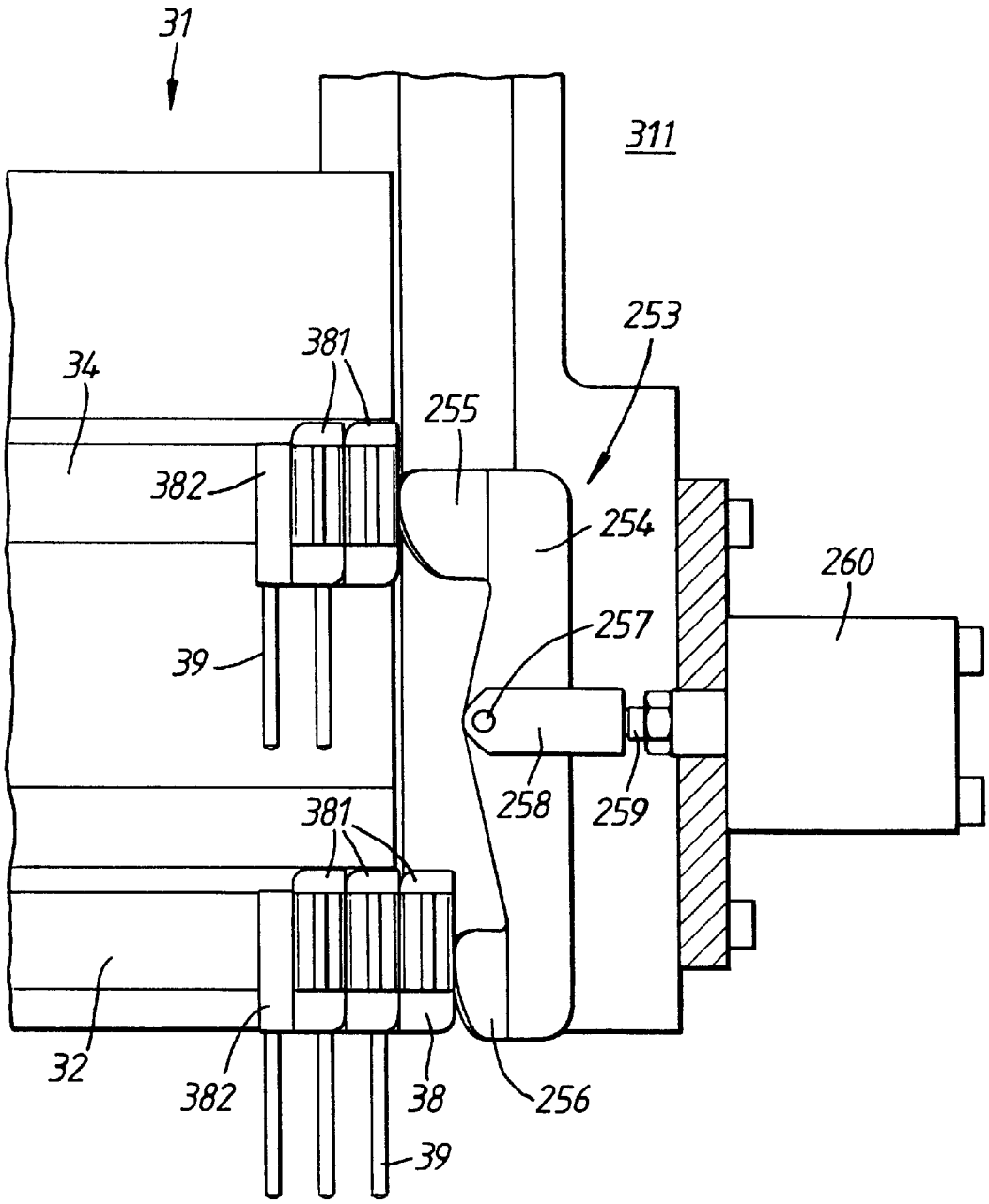
FIG. 11 is a schematic part sectional side elevation of the delivery end of a loop portion holding mechanism for the machine shown in FIG. 2A and showing to an enlarged scale an alternative biasing structure for biasing pin blocks at the delivery end of the mechanism as well as pin blocks of an alternative form to the pin blocks illustrated in FIGS. 3 to 8.

As will be seen from FIG. 11, pin blocks 381 in the pin block advancement track 32 and the pin block return track 34 on one side of the machine are biased at the delivery end 311 of the mechanism 31 in the direction of the feed end of the mechanism by an arm 254 which carries pin block engaging parts 255 and 256 and which is pivotally mounted by a pin 257 in a yolk member 258 carried by a piston rod 259 to which a biasing thrust is applied by a pneumatic cylinder 260. A further biasing structure identical to the structure 253 is provided at the other side of the mechanism at the delivery end 311 to provide for the biasing of the pin blocks 381 in the pin block advancement track 33 and the pin block return track 35.

The use in the embodiment described with reference to FIGS. 3 and 4 of the numerous shafts and linkages provided with the pneumatic cylinders 54 and 61 for exerting the biasing forces on the pin blocks 38 at the delivery end is thus conveniently replaced by the simplified arrangement of biasing arms 254 of the two biasing structures 253 in the arrangement illustrated in FIG. 11.

Figure 12:
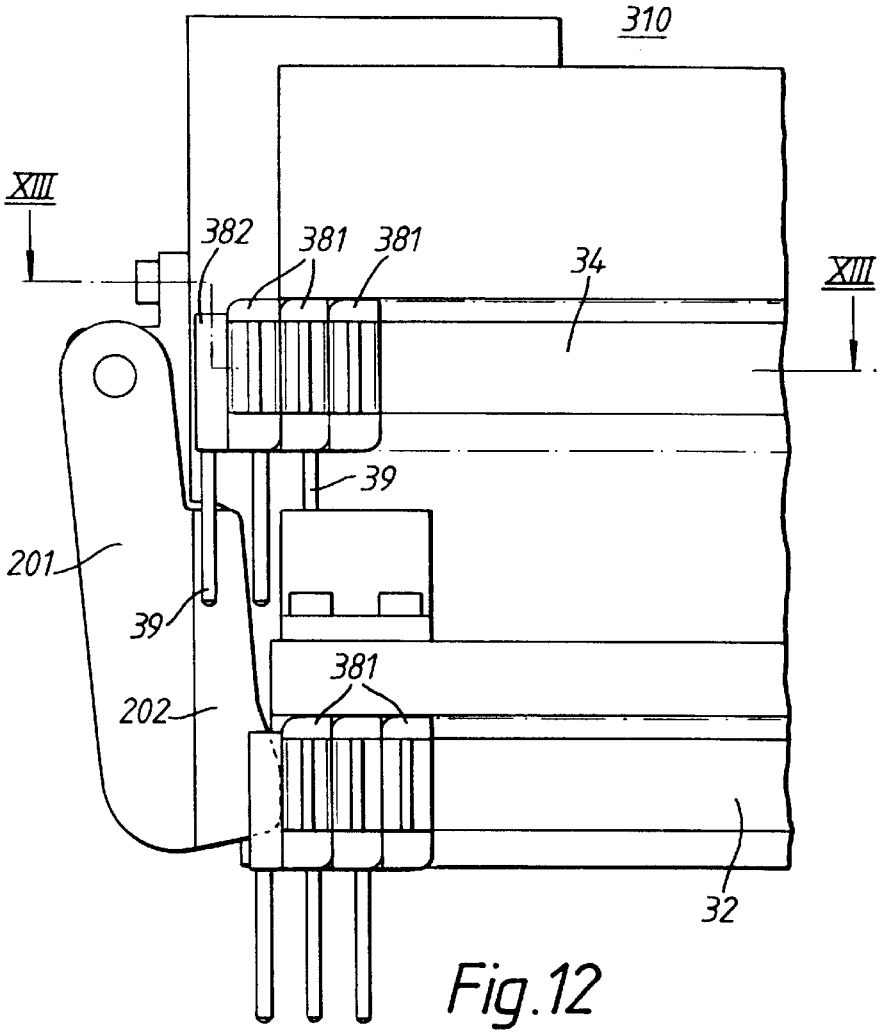
FIG. 12 is a schematic part sectional side elevation of the feed end of the loop portion holding mechanism of the machine shown in FIG. 2, illustrating pin blocks of the alternative form and alternative biasing structure for the pin blocks at the feed end.
Figure 13:
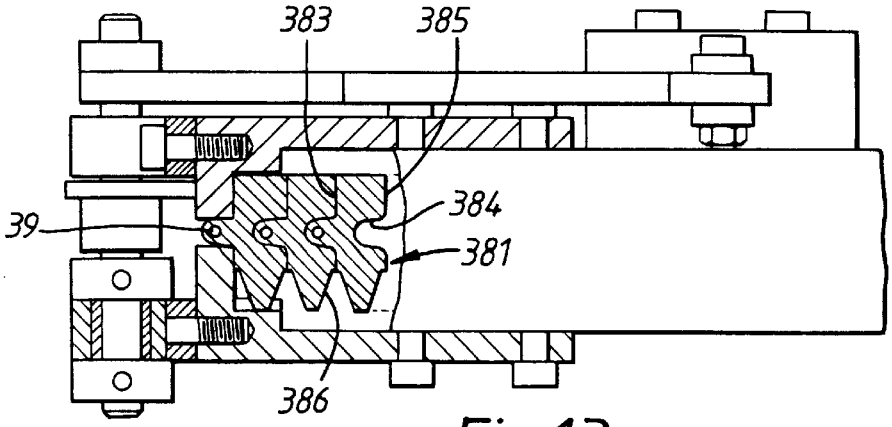
FIG. 13 is a sectional plan view of the feed end of the mechanism shown in FIG. 12, taken on the line XIII—XIII in FIG. 12 with parts cut away to reveal some detail below the section line.

It will be seen that the pin block 381 illustrated in FIG. 11 takes an alternative form to that of the pin block 38 of the embodiment described with reference to FIGS. 3 to 8. In particular, and as best seen in FIGS. 12 and 13, depending pins 39 of the pin blocks 381 are secured to a nose portion 382 which extends from the rear face 383 of each pin block. When in abutting relationship with other pin blocks in the advancement and return tracks the nose portion 382 of each pin block 381 engages in a complementary recess 384 in the front face 385 of the next adjacent pin block, as best seen in FIG. 13. Such relocation of the pin 39 enables the pin at the feed end 310 of the mechanism 31 to protrude between the beater pins 301 of the beater 30 and obviates the need to activate or crank a beater pin 301 around the pin block as illustrated in FIG. 5.

It will furthermore be seen from FIG. 13 that the pin block 381 includes a tooth profile 386 of full form which replaces the half tooth profile 68 of the pin block 38 shown in FIG. 8.

It will of course be appreciated that the pin blocks may take any one of a variety of different forms depending upon the conditions under which they are required to operate.

It will also be seen that in the embodiment illustrated in FIGS. 12 and 13 a biasing arm 201 is provided for biasing the pin blocks 381 into the advancement track on each side of the machine and that it takes a form different from that of the cranked arm 52 of the FIG. 3 embodiment and the cranked arm 156 of the FIG. 9 embodiment. The arm 201 in particular includes a pin block engaging rib 202 of such dimensions as to enable it to pass into the space between adjacent pins 301 of the beater 30 as now to be described with reference to FIGS. 14 and 15.

Figure 14:
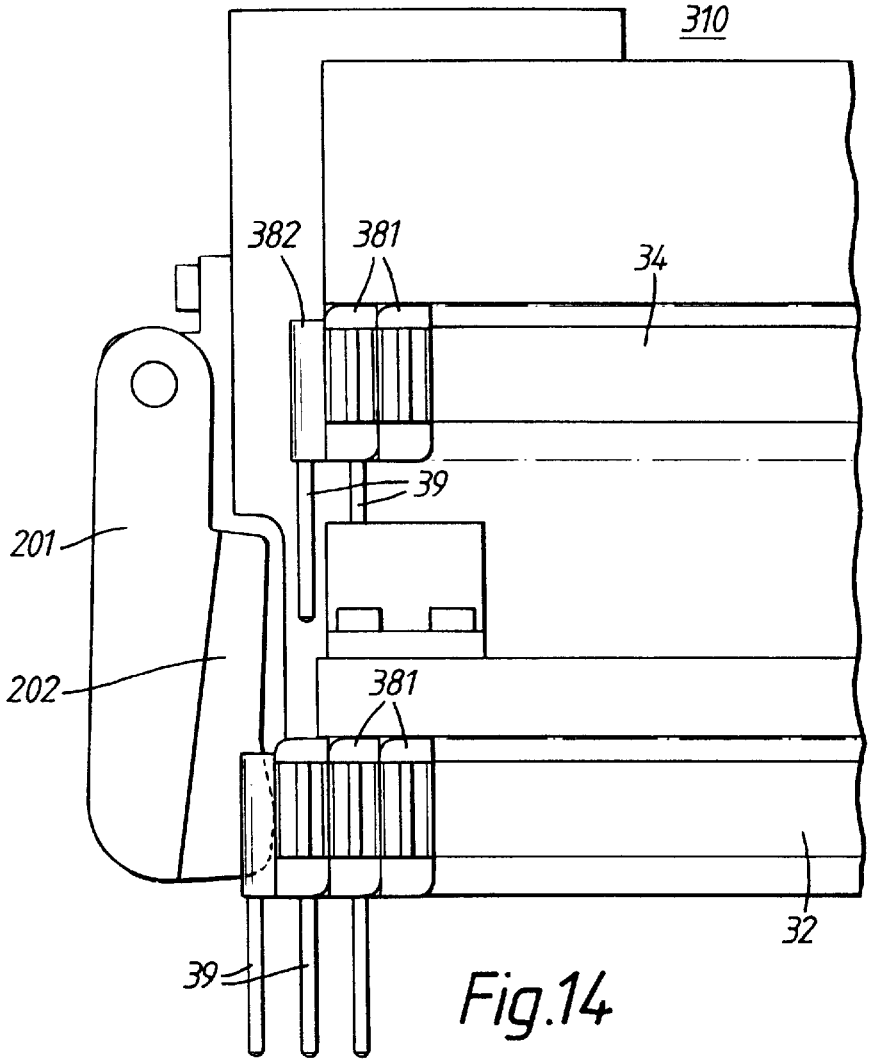
FIG. 14 is a schematic part sectional side elevation of the feed end of the loop portion holding mechanism shown in FIG. 12, except insofar as the pin block at the feed end of the mechanism is shown displaced to a lowered disposition where it is engaged by the alternative biasing structure.
Figure 15:
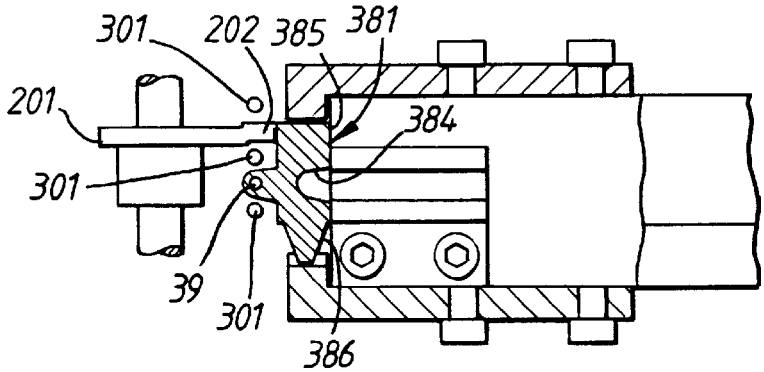
FIG. 15 is a schematic part sectional plan view of the feed end of the mechanism shown in FIG. 12 with the pin block displaced to the lowered disposition illustrated in FIG. 14.

It will be seen that in FIGS. 12 and 13 a pin block 381 has taken up a delivery position at the end of the pin block return track 34 ready for displacement to the pin insertion position at the entry end of the pin block advancement track 32. In the manner hereinbefore described this pin block 381 is displaced by the actuator 43 to the pin insertion position as illustrated in FIG. 14. During this movement it displaces the biasing arm 201, with the rib 202 being brought to bear on the rear face 383 of the pin block 381 when the pin block 381 takes up the pin insertion position at the entrance to the pin block advancement track 32. As will be seen from FIG. 15 the rib 202 of the arm 201 passes through the space between two adjacent pins 301 of the beater 30 or on the outside of the final beater pin 301 thereby obviating the need to crank one of the beater pins 301 as illustrated in FIG. 5.

In the yarn structure forming machine described with reference to FIGS. 2A and 2B, the yarn transfer mechanism 18 comprises the lower yarn guide member 21 and the yarn transfer member 22 which subjects the warp yarns of the warp sheet 17 to the succession of bias yarn forming steps in which each yarn is caused to move in a succession of lateral transfer steps first in one direction and then in the opposite direction to produce the inclined sub-assemblies of bias yarns 11 and 12. As hereinbefore described, the loop portion holding mechanism 31 is arranged to complete successive cycles of operation, each of which commences following a bias yarn transfer step by the yarn transfer mechanism 18, a binding warp yarn insertion step, a weft insertion step and a beating up step using the beater 30 which brings the bias yarns 11 and 12 and the newly inserted weft yarns to the fell point of the yarn structure being formed. The loop portions 101 and 102 of the bias yarns 11 and 12 of the newly formed structure are brought into position in the pin insertion stations 40 and 41 of the mechanism 31 and a complete cycle of operation of the mechanism 31 then follows.

What is claimed is:

1. A loop holding mechanism (31) for engaging and holding loop portions of yarns successively formed at first and second edges of a multi-axial yarn structure being formed, the loop holding mechanism (31) comprising:

(a) a plurality of pin blocks (38) each of which carries a loop engaging pin (39), and (b) first and second pin block advancement tracks (32, 33) in which the pin blocks (38) are advanced from first and second pin insertion stations (40, 41) to first and second pin retraction stations (44, 45) spaced from the first and second pin insertion stations (40, 41) in the direction in which the formed multi-axial yarn structure is to be advanced, characterised by the fact that the loop holding mechanism (31) further comprises:

(c) first and second pin block return tracks (34, 35) in which pin blocks (38) are returned from the first and second pin retraction stations (44, 45) to the first and second pin insertion stations (40, 41), (d) first and second pin-block insertion means (43) at the first and second pin insertion stations (40, 41) successively to transfer pin blocks (38) from the return tracks (34, 35) to the advancement tracks (32, 33) for insertion of pins (39) of the pin blocks (38) in loop portions (101, 102) successively formed at the pin insertion stations (40, 41), (e) first and second pin-block retraction means (47) at the first and second pin retraction stations (44, 45) to transfer the pin blocks (38) from the first and second advancement tracks (32, 33) to the first and second return tracks (34, 35) thereby successively to retract pins (39) of the pin blocks (38) from the loop portions (101, 102) at the pin retraction stations (44, 45), (f) advancement track pin block biasing means (48, 53) to bias the pin blocks (38) in each of the pin block advancement tracks (32, 33) into abutting engagement with each other, and (g) a drive mechanism (67) at a drive station in each of the advancement tracks (32, 33) to engage in turn each pin block (38) advanced thereto under the bias of the biasing means (48, 53) to drive the engaged pin block (38) and all the pin blocks (38) in the advancement track (32, 33) between the drive station and the pin retraction station (44, 45) along the pin advancement track (32, 33) in the direction of the pin retraction station (44, 45) against the action of the biasing means (48, 53) to bring a pin block (38) into the pin retraction station (44, 45) and to permit all pin blocks (38) in the track (32, 33) between the drive station and the pin insertion station (40, 41) to advance in the advancement track (32, 33) under the bias of the biasing means (48, 53) to bring a pin block (38) out of the pin insertion station (40, 41) and into the pin block advancement track (32, 33) and to advance a pin block (38) into the drive station.

2. A mechanism according to claim 1 wherein:

(a) the drive station in each of the advancement tracks (32, 33) is located at a position along the track intermediate the pin insertion station (40, 41) and the pin retraction station (44, 45) and (b) the advancement track pin block biasing means (48, 53) comprises:

(i) forwardly acting biasing means (48) located at the pin insertion station (40, 41) in each advancement track (32, 33) to bias the pin blocks (38) between the pin insertion station (40, 41) and the drive station in the direction of the drive station and into abutment with each other and (ii) rearwardly acting biasing means (53) located at the pin retraction station (44, 45) to bias the pin blocks (38) between the drive station and the pin retraction station (44, 45) in the direction of the drive station and into abutment with each other.

3. A mechanism according to claim 2 wherein:

(a) the drive mechanism (67) at the drive station of each pin-block advancement track (32, 33) comprises a drive pinion (69) located at the drive station and provided with equi-spaced peripheral teeth (70) and (b) each pin block (38) carries a tooth element (68) which is engagable at the drive station by a peripheral tooth (70) on the pinion (69) for advancement of the pin block (38) along the pin block advancement track (32, 33) upon rotary movement of the pinion (69).

4. A mechanism according to claim 3 wherein:

(a) each pin insertion station (40, 41) includes a pin block insertion guide track (42) extending between an exit end of the pin block return track (34, 35) and an entry end of the pin block advancement track (32, 33) and (b) the pin block insertion means (43) provides for displacing a pin block (38) at a pin block delivery position in the pin block insertion track (42) at the exit end of the pin block return track (34, 35) to a pin insertion position in the pin block insertion track (42) at the entry end of the pin block advancement track (32, 33) to insert the pin (39) of the pin block (38) in the yarn loop portion at the station (40, 41) and for entry of the pin block (38) into the pin block advancement track (32, 33).

5. A mechanism according to claim 4 wherein:

(a) each pin retraction station (44, 45) extends between an exit end of the pin block advancement track (32, 33) and an entry end of the pin block return track (34, 35) and (b) the pin block retraction means (47) provides for displacing a pin block (38) at a pin block retraction position in the pin retraction station (44, 45) at the exit end of the pin block advancement track (32, 33) to retract the pin (39) of the pin block (38) from the yarn loop portion and to deliver the pin block (38) to a pin block return position in the pin retraction station (44, 45) at the entry end of the pin block return track (34, 35) for entry into the pin block return track (34, 35).

6. A mechanism according to claim 4 wherein the pin block advancement and return tracks (32, 33; 34, 35) are arranged to provide for horizontal movement of the pin blocks (38) and wherein the pin block insertion guide tracks (42) and the pin block retraction means (47) are arranged to provide for movement of the pin blocks (38) vertically during insertion of pins (39) of the pin blocks (38) into the loop portions of the yarn structure being formed and during retraction of the pins (39) of the pin blocks (38) at the pin retraction stations (44, 45).

7. A mechanism according to claim 5 wherein a return track pin-block biasing means (60) is provided at the entry end of the pin block return track (34, 35) to bias the pin block (38) at the pin block return position and all the pin blocks (38) in the pin block return track (34, 35) into abutting relationship for movement in the return track (34, 35) in the direction of the pin insertion station (40, 41).

8. A mechanism according to claim 7 wherein each pin block (38) arriving at the exit end of the return track (34, 35) is delivered to the pin block delivery position in the pin insertion station (40, 41) under the action of the return track pin-block biasing means (60).

9. A mechanism according to claim 1 wherein:

(a) the first pin block return track (34) is arranged parallel to and above the first pin block advancement track (32), (b) the second pin block return track (35) is arranged parallel to and above the second pin block advancement track (33), and (c) the pin block retraction means (47) at each pin retraction station (44, 45) comprises a lifting device (47) which engages the pin block (38) at the pin block retraction position and lifts it to the pin block return position.

10. A mechanism according to claim 9 wherein the lifting device (47) comprises a displaceable member carrying retractable support means (471, 472) which ride over the pin block (38) in a downward excursion of the lifting device (47) and engage under the pin block (38) or a part or parts thereof to support the pin block (38) during a return excursion of the lifting device (47), whereby the pin block is lifted to the pin block return position.

11. A mechanism according to claim 10 wherein the displaceable member is a displaceable arm and wherein the retractable support means (471, 472) takes the form of one or more spring biased pawls.

12. A machine for forming a multi-axial yarn structure comprising:

(a) loop holding mechanism (31) including a plurality of pin blocks (38) each of which carries a loop engaging pin (39), first and second pin block advancement tracks (32, 33) in which the pin blocks (38) are advanced from first and second pin insertion stations (40, 41) to first and second pin retraction stations (44, 45) spaced from the first and second pin insertion stations (40, 41) in the direction in which the formed multi-axial yarn structure is to be advanced, first and second pin block return tracks (34, 35) in which pin blocks (38) are returned from the first and second pin retraction stations (44, 45) to the first and second pin insertion stations (40, 41), first and second pin-block insertion means (43) at the first and second pin insertion stations (40, 41) successively to transfer pin blocks (38) from the return tracks (34, 35) to the advancement tracks (32, 33) for insertion of pins (39) of the pin blocks (38) in loop portions (101, 102) successively formed at the pin insertion stations (40, 41), first and second pin-block retraction means (47) at the first and second pin retraction stations (44, 45) to transfer the pin blocks (38) from the first and second advancement tracks (32, 33) to the first and second return tracks (34, 35) thereby successively to retract pins (39) of the pin blocks (38) from the loop portions (101, 102) at the pin retraction stations(44, 45), advancement track pin block biasing means (48, 53) to bias the pin blocks (38) in each of the pin block advancement tracks (32, 33) into abutting engagement with each other, and a drive mechanism (67) at a drive station in each of the advancement tracks (32, 33) to engage in turn each pin block (38) advanced thereto under the bias of the biasing means (48, 53) to drive the engaged pin block (38) and all the pin blocks (38) in the advancement track (32, 33) between the drive station and the pin retraction station (44, 45) along the pin advancement track (32, 33) in the direction of the pin retraction station (44, 45) against the action of the biasing means (48, 53) to bring a pin block (38) into the pin retraction station (44, 45) and to permit all pin blocks (38) in the track (32, 33) between the drive station and the pin insertion station (40, 41) to advance in the advancement track (32, 33) under the bias of the biasing means (48, 53) to bring a pin block (38) out of the pin insertion station (40, 41) and into the pin block advancement track (32, 33) and to advance a pin block (38) into the drive station, (b) warp yarn supply means (16) for supplying in a warp feed direction (F) warp yarns in the form of a warp sheet (17) and (c) a yarn transfer device (18) which subjects the warp yarns to successive bias yarn forming steps in which each yarn is caused to move in a succession of lateral transfer steps in a first weft direction from a first bias yarn reversal position to a second bias yarn reversal position and then to move in a succession of return lateral transfer steps in the opposite direction form the second bias yarn reversal position to the first bias yarn reversal position thereby to form a non-woven bias yarn assembly comprising two superposed non-woven bias yarn sub-assemblies in which (i) the bias yarns (11) of one sub-assembly are inclined to the bias yarns (12) of the other sub-assembly, and (ii) the bias yarns (11, 12) are inclined to the warp feed direction and wherein the loop holding mechanism (31) and the yarn transfer device (18) are so disposed that the bias yarns (11, 12) at each bias yarn reversal position in proceeding from a transfer step in one direction to a transfer step in the opposite direction form bias yarn loop portions (101, 102) at the first and second edges of the structure being formed.

13. A mechanism according to claim 12 wherein:

(a) the drive station in each of the advancement tracks (32, 33) is located at a position along the track intermediate the pin insertion station (40, 41) and the pin retraction station (34, 45) and (b) the advancement track pin block biasing means (48, 53) comprises:

(i) forwardly acting biasing means (48) located at the pin insertion station (40, 41) in each advancement track (32, 33) to bias the pin blocks (38) between the pin insertion station (40, 41) and the drive station in the direction of the drive station and into abutment with each other and (ii) rearwardly acting biasing means (53) located at the pin retraction station (44, 45) to bias the pin blocks (38) between the drive station and the pin retraction station (44, 45) in the direction of the drive station and into abutment with each other.

14. A mechanism according to claim 13 wherein:

(a) the drive mechanism (67) at the drive station of each pin-block advancement track (32, 33) comprises a drive pinion (69) located at the drive station and provided with equi-spaced peripheral teeth (70) and (b) each pin block (38) carries a tooth element (68) which is engagable at the drive station by a peripheral tooth (70) on the pinion (69) for advancement of the pin block (38) along the pin block advancement track (32, 33) upon rotary movement of the pinion (69).

15. A mechanism according to claim 14 wherein:

(a) each pin insertion station (40, 41) includes a pin block insertion guide track (42) extending between an exit end of the pin block return track (34, 35) and an entry end of the pin block advancement track (32, 33) and (b) the pin block insertion means (43) provides for displacing a pin block (38) at a pin block delivery position in the pin block insertion track (42) at the exit end of the pin block return track (34, 35) to a pin insertion position in the pin block insertion track (42) at the entry end of the pin block advancement track (32, 33) to insert the pin (38) of the pin block (38) in the yarn loop portion at the station (40, 41) and for entry of the pin block (38) into the pin block advancement track (32, 33).

16. A mechanism according to claim 15 wherein:

(a) each pin retraction station (44, 45) extends between an exit end of the pin block advancement track (32, 33) and an entry end of the pin block return track (34, 35) and (b) the pin block retraction means (47) provides for displacing a pin block (38) at a pin block retraction position in the pin retraction station (44, 45) at the exit end of the pin block advancement track (32, 33) to retract the pin (39) of the pin block (38) from the yarn loop portion and to deliver the pin block (38) to a pin block return position in the pin retraction station (44, 45) at the entry end of the pin block return track (34, 35) for entry into the pin block return track (34, 35).

17. A mechanism according to claim 15 wherein the pin block advancement and return tracks (32, 33; 34, 35) are arranged to provide for horizontal movement of the pin blocks (38) and wherein the pin block insertion guide tracks (42) and the pin block retraction means (47) are arranged to provide for movement of the pin blocks (38) vertically during insertion of pins (39) of the pin blocks (38) into the loop portions of the yarn structure being formed and during retraction of the pins (39) of the pin blocks (38) at the pin retraction stations (44, 45).

18. A mechanism according to claim 16 wherein a return track pin-block biasing means (60) is provided at the entry end of the pin block return track (34, 35) to bias the pin block (38) at the pin block return position and all the pin blocks (38) in the pin block return track (34, 35) into abutting relationship for movement in the return track (34, 35) in the direction of the pin insertion station (40, 41).

19. A mechanism according to claim 18 wherein each pin block (38) arriving at the exit end of the return track (34, 35) is delivered to the pin block delivery position in the pin insertion station (40, 41) under the action of the return track pin-block biasing means (60).

20. A mechanism according to claim 12 wherein:

(a) the first pin block return track (34) is arranged parallel to and above the first pin block advancement track (32), (b) the second pin block return track (35) is arranged parallel to and above the second pin block advancement track (33), and (c) the pin block retraction means (47) at each pin retraction station (44, 45) comprises a lifting device (47) which engages the pin block (38) at te pin block retraction position and lifts it to the pin block return position.

21. A mechanism according to claim 20 wherein the lifting device (47) comprises a displaceable member carrying retractable support means (471, 472) which ride over the pin block (38) in a downward excursion of the lifting device (47) and engage under the pin block (38) or a part or parts thereof to support the pin block (38) during a return excursion of the lifting device (47), whereby the pin block is lifted to the pin block return position.

22. A mechanism according to claim 21 wherein the displaceable member is a displaceable arm and wherein the retractable support means (471, 472) takes the form of one or more spring biased pawls.

* * * * *